US006821139B1

(12) United States Patent
Wu

(10) Patent No.: US 6,821,139 B1
(45) Date of Patent: Nov. 23, 2004

(54) CABLE END CONNECTOR ASSEMBLY HAVING LOCKING MEMBER

(75) Inventor: Jerry Wu, Irvine, CA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 10/665,060

(22) Filed: Sep. 17, 2003

(51) Int. Cl.[7] ..... H01R 13/627
(52) U.S. Cl. ..... 439/352; 439/354; 439/358
(58) Field of Search ..... 439/352–358

(56) References Cited

U.S. PATENT DOCUMENTS 5,660,558 A * 8/1997 Osanai et al. ..... 439/353
5,879,194 A * 3/1999 Thenaisie et al. ..... 439/607
6,346,002 B1 * 2/2002 Hsu et al. ..... 439/358
6,454,577 B1 * 9/2002 Yi ..... 439/108
6,565,383 B1 5/2003 Wu
6,585,536 B1 7/2003 Wu
6,585,537 B1 7/2003 Lee
6,655,979 B1 * 12/2003 Lee ..... 439/357

* cited by examiner

*Primary Examiner*—P. Austin Bradley
*Assistant Examiner*—X. Chung-Trans
(74) *Attorney, Agent, or Firm*—Wei Te Chung

(57) ABSTRACT

A cable end connector assembly (10) for mating with a complementary connector (20) includes an insulative housing (12), a number of contacts (130) received in the insulative housing, a spacer (13) mounted to a rear end of the insulative housing, a cable (14) including a number of conductors (140) electrically connecting with corresponding contacts, a cover (15) over-molded with the insulative housing and the cable, and a locking member (16). The locking member includes a retaining section (160) secured with the insulative housing and a locking section (161) extending rearwardly from the retaining section. The locking section (161) has a pair of lower tabs (1611) and a pair of latch portions (1610) for locking with the complementary connector.

10 Claims, 11 Drawing Sheets

CABLE END CONNECTOR ASSEMBLY HAVING LOCKING MEMBER

CROSS-REFERENCE TO RELATED APPLICATIONS

This application is related to U.S. patent application Ser. No. 10/660,315 filed on Sep. 10, 2003 and entitled "CABLE END CONNECTOR ASSEMBLY HAVING LOCKING MEMBER", which is invented by the same inventor and assigned to the same assignee as this application and which is hereby fully incorporated by reference.

BACKGROUND OF THE INVENTION

1. Field of the Invention

The present invention relates to a cable end connector assembly, and particularly to a cable end connector assembly having a locking member for locking with a complementary connector.

2. Description of Related Art

There exists in the art an electrical connector known as a Serial Advanced Technology Attachment (Serial ATA) connector which is generally used for disk drives and storage peripherals. Especially, the Serial ATA connectors according to the Serial ATA standard are featured in fewer electrical contacts than other conventional electrical connectors and are relatively tiny in configuration. It is desirable for the Serial ATA connector to have latch means for providing a reliable mechanical and electrical connection with a complementary connector. U.S. Pat. Nos. 6,565,383 and 6,585,536, having the same inventor and the same assignee with the present invention, each disclose a Serial ATA connector equipped with a locking member for locking with a complementary connector. The locking member comprises a middle portion retained on a connector housing, a pushing portion extending rearwardly from the middle portion, and a locking portion extending forwardly from the middle portion for locking/releasing the Serial ATA connector with/from the complementary connector.

However, since the middle portion of the locking member is retained on the connector housing, the distance between a locking position and a releasing position of the locking portion is relatively small, thereby adversely affecting the engagement and disengagement between the Serial ATA connector and the complementary connector.

Hence, a cable end connector assembly having an improved locking member is desired.

SUMMARY OF THE INVENTION

An object of the present invention is to provide a cable end connector assembly having an improved locking member for locking the cable end connector assembly with a complementary connector.

To achieve the above object, a cable end connector assembly in accordance with the present invention comprises an insulative housing, a plurality of contacts received in the insulative housing, a spacer mounted to a rear end of the insulative housing, a cable comprising a plurality of conductors electrically connecting with corresponding contacts, a cover over-molded with the insulative housing and the cable, and a locking member. The locking member comprises a retaining section secured with the insulative housing, a locking section extending rearwardly from the retaining section. The locking section has a pair of lower tabs and a pair of latch portions for locking with the complementary connector, Other objects, advantages and novel features of the invention will become more apparent from the following detailed description when taken in conjunction with the accompanying drawings.

DETAILED DESCRIPTION OF THE INVENTION

Figure 1:
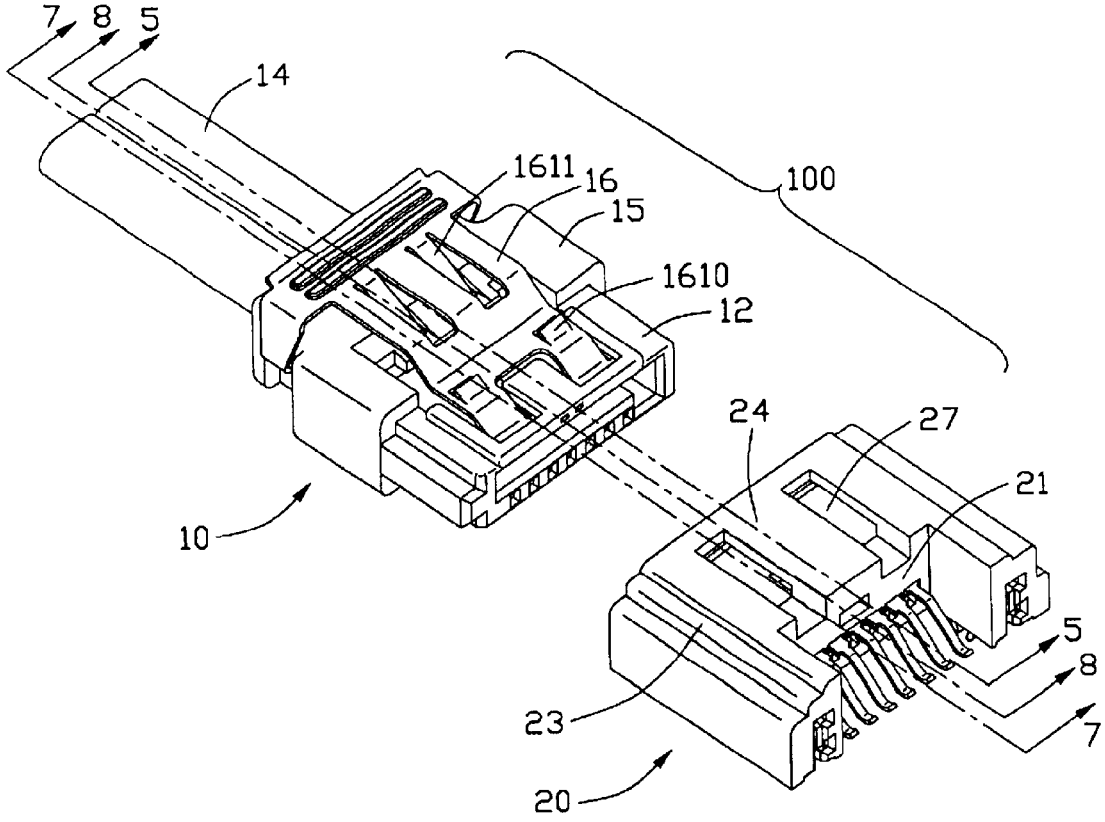
FIG. 1 is a perspective view of an electrical connector assembly comprising a cable end connector assembly in accordance with the present invention and a complementary connector.
Figure 2:
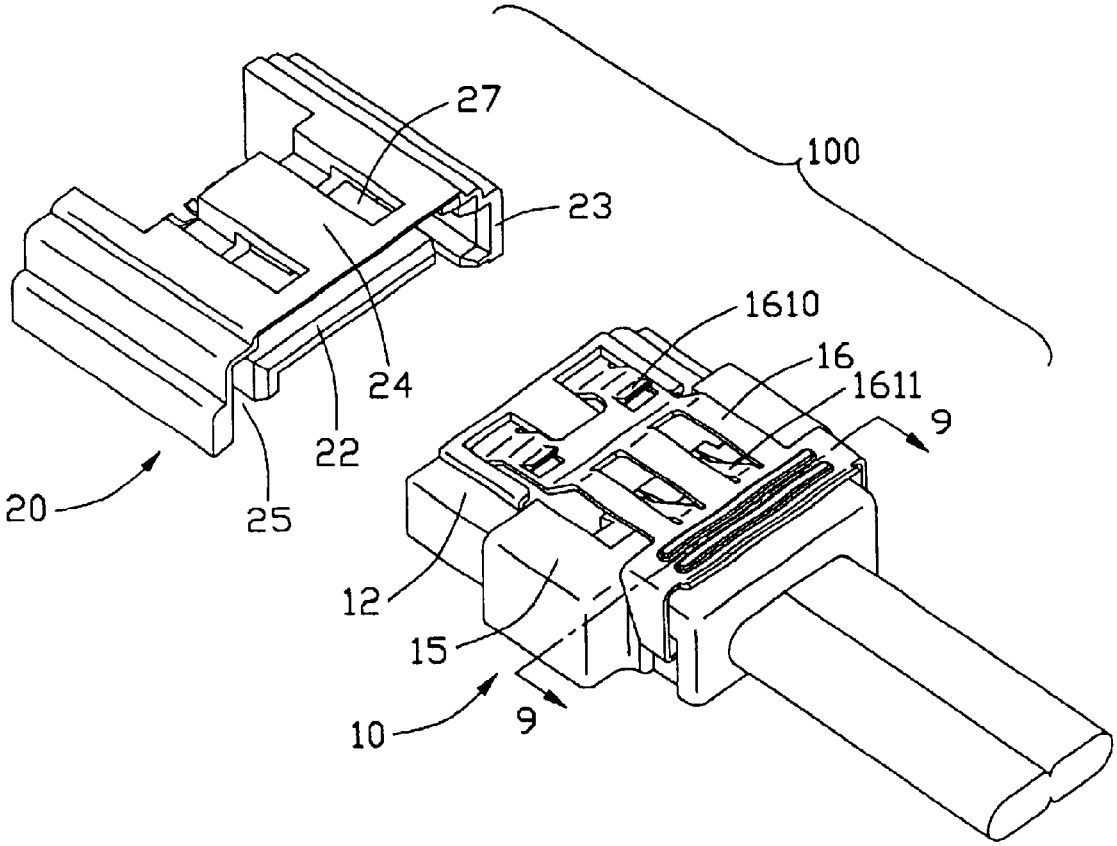
FIG. 2 is a view similar to FIG. 1, but taken from a different aspect.
Figure 3:
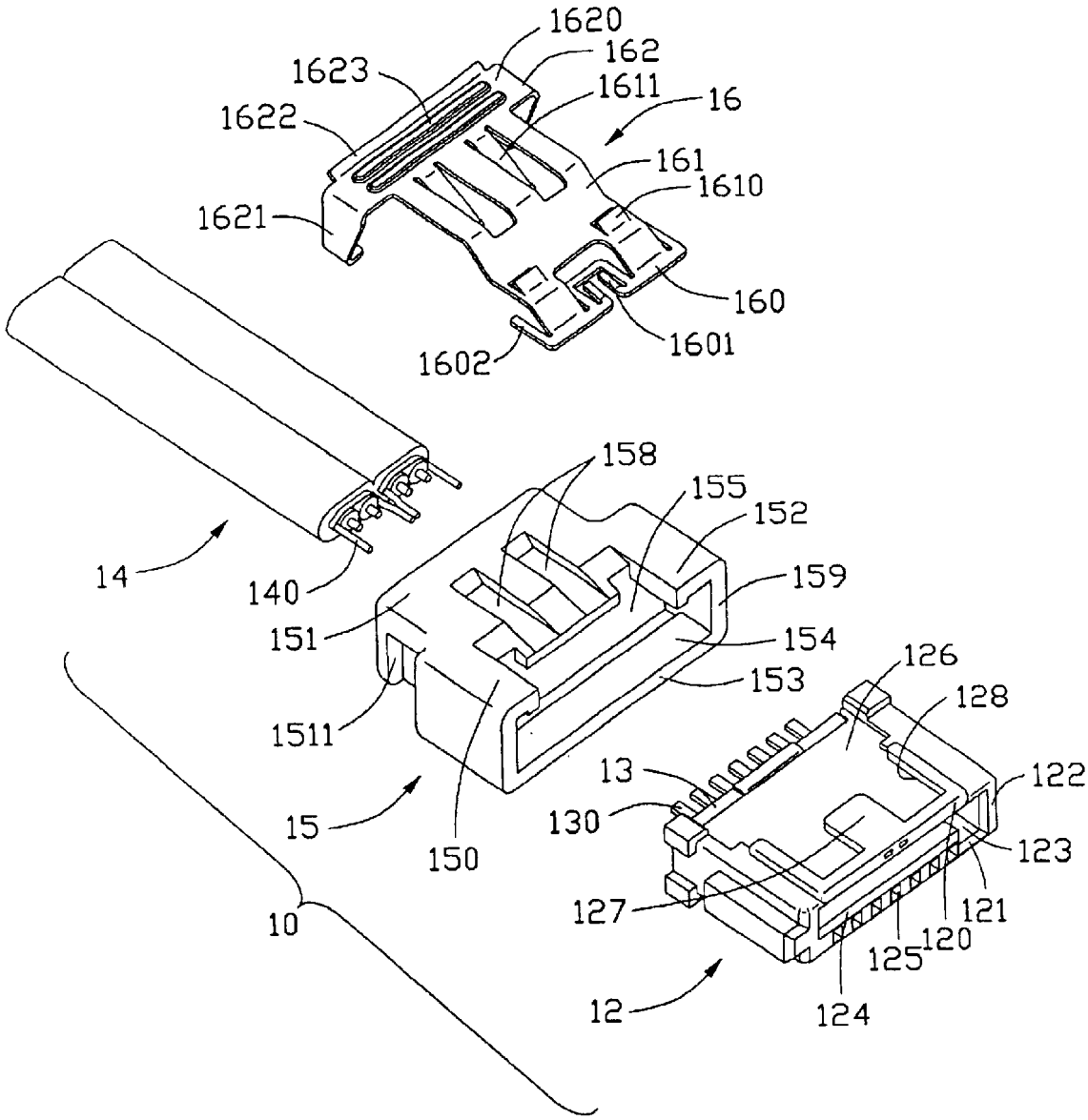
FIG. 3 is an exploded perspective view of the cable end connector assembly of FIG 1.
Figure 4:
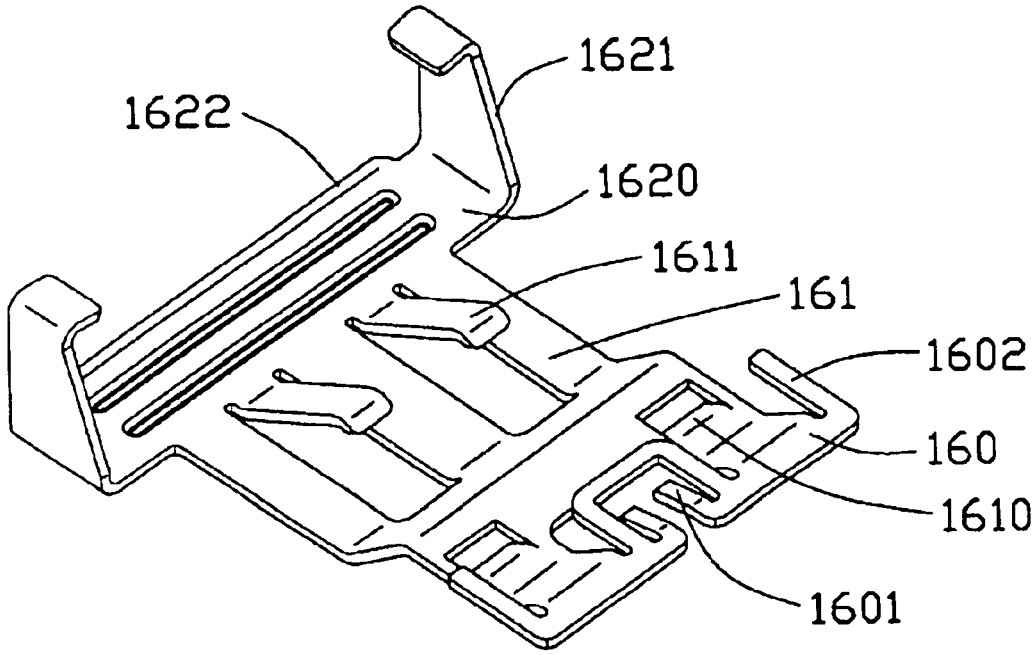
FIG. 4 is an enlarged perspective view of a locking member of the cable end connector assembly.

Referring to FIGS. 1 and 2, an electrical connector assembly 100 comprises a cable end connector assembly 10 in accordance with the present invention and a complementary connector 20. In a preferred embodiment, the cable end connector assembly 10 and the complementary connector 20 are typical Serial ATA connectors. However, in alternative embodiments, the electrical connectors could be provided as other types.

Referring to FIGS. 3–9, the cable end connector assembly 10 comprises an insulative housing 12, a plurality of contacts 130, a spacer 13, a cable 14, a cover 15 and a locking member 16. The insulative housing 12 comprises an upper wall 120, a lower wall 121 opposite to the upper wall 120, and a pair of sidewalls 122 connecting with the upper wall 120, the lower wall 121 and the sidewalls 122. An L-shaped receiving space 123 is defined between the upper and the lower walls 120, 121. A block 124 is formed on the lower wall 121 and protrudes into the receiving space 123. The block 124 defines a plurality of passageways 125 extending therethrough. The upper wall 120 defines a depression 126 on an upper surface thereof. A flat portion 127 extends rearwardly from a middle portion of a front flange of the upper wall 120 into the depression 126. A slit 1270 is formed between the flat portion 127 and a bottom surface of the depression 126. The upper wall 120 defines a pair of grooves 128 extending along opposite inner sides of the depression 126. A pair of slots 129 extending rearwardly from a front face of the upper wall 120 into the flat portion 127 and communicating with the slit 1270, respectively.

The contacts 130 are received in the passageways 125 of the insulative housing 12 with tail portions (not labelled) thereof extending rearwardly beyond a rear face of the insulative housing 12. The spacer 13 is mounted to a rear end of the insulative housing 12 and defines a plurality of through holes (not labelled) for allowing the tail portions of the contacts 130 extending therethrough. The spacer 13 can prevent plastic from entering into the passageways 125 of the insulative housing 12 during the molding of the cover 15. The contacts 130 and the spacer 13 can be integrally formed before mounting to the insulative housing 12, if desired.

The cable 14 comprises a plurality of conductors 140 exposed outside.

The cover 15 is over-molded with the insulative housing 12 and the cable 14 and comprises a rectangular body portion 150 and a rear portion 151 extending rearwardly from the body potion 150. The body portion 150 comprises an upper plate 152, a lower plate 153 opposite to the upper plate 152, and a pair of side plates 159 connecting with the upper plate 152, the lower plate 153 and the side plates 159. A receiving cavity 154 is defined between the upper and the lower plates 152, 153 for receiving a rear end of the insulative housing 12. The upper plate 152 defines a cutout 155 in a front end thereof. The upper plate 152 defines a pair of channels 158 communicating with the cutout 155. The rear portion 151 defines a hole 1510 communicating with the receiving cavity 154 for receiving the cable 14. The rear portion 151 defines a pair of recesses 1511 on opposite sides thereof.

The locking member 16 is stamped and formed from a metallic plate and comprises a retaining section 160, a locking section 161 extending upwardly and rearwardly from the retaining section 160. The retaining section 160 has a bar portion 1602 extending rearwardly from opposite ends thereof and a pair of snap portions 1601 extending upwardly and rearwardly from a middle portion of a front end thereof. The locking section 161 comprises a pair of latch portions 1610 extending upwardly and rearwardly from a front portion thereof, a pair of lower resilient tabs 1611 extending downwardly and forwardly from a rear portion thereof, and a pushing section 162 formed on the rear portion thereof. The pushing section 162 comprises a body portion 1620, a pair of side beams 1621 extending downwardly from opposite ends of the body portion 1620, and a bent portion 1622 extending upwardly from a rear end of body portion 1620. The body portion 1620 is formed with a plurality of ribs 1623 for facilitating handling. The bent portion 1622 and the ribs 1623 increase mechanical strength of the body portion 1620 to prevent the body portion 1620 from deforming.

Referring to FIGS. 1, 2 and 5–9, in assembly, the conductors 140 of the cable 14 are first soldered to the contacts 130, which are exposed outside the insulative housing 12. The cover 15 is over-molded with the rear end of the insulative housing 12 with the front end of the cable 14 received in the hole 1510. The cutout 155 of the cover 15 communicates with the depression 126 of the insulative housing 12. The locking member 16 is then assembled to the insulative housing 12 and the cover 15 with the bar portions 1602 received in the grooves 128 of the insulative housing 12. The middle portion of the retaining portion 160 is received in the slit 1270 with the snap portions 1601 locked with the slots 129 to prevent the locking member 16 from moving rearwardly when the cable end connector assembly 10 mates with the complementary connector 20. The lower tabs 1611 are received in the channels 158 of the cover 15 and abut against bottom surfaces of the channels 158. The pushing section 162 moves downwardly to partially enclose the rear portion 151 of the cover 15 with distal ends of the side beams 1621 bent inwardly and received in the recesses 1511. The pushing section 162 is downwardly movable relative to the rear portion 151 of the cover 15 to deflect the locking section 161 toward the cover 15 and the insulative housing 12.

Figure 5:
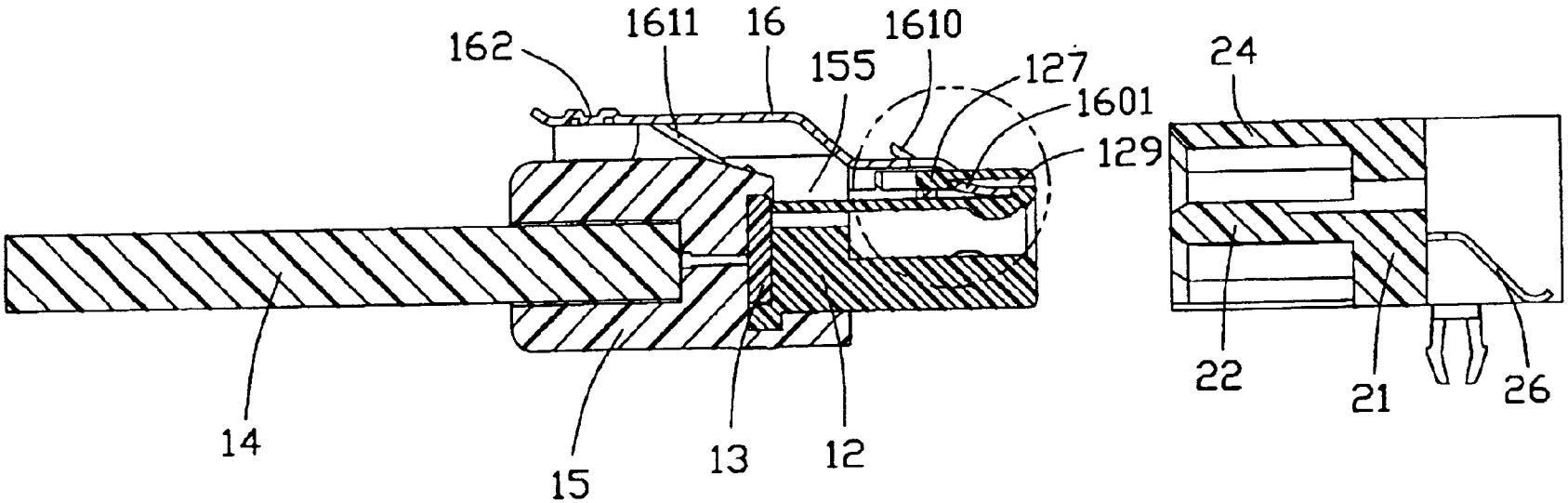
FIG. 5 is a cross-sectional view taken along line 5—5 of FIG 1.
Figure 6:
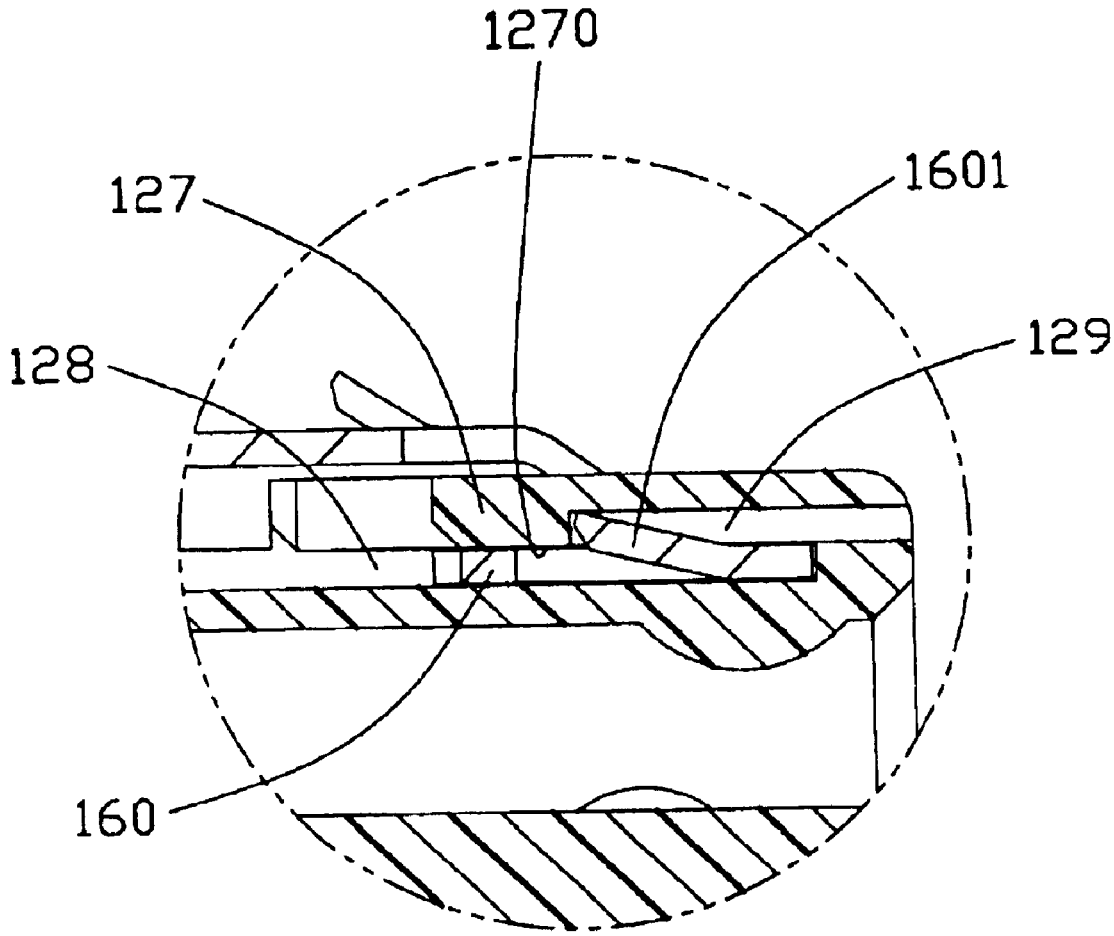
FIG. 6 is an enlarged view taken from a circle of FIG. 5.
Figure 7:
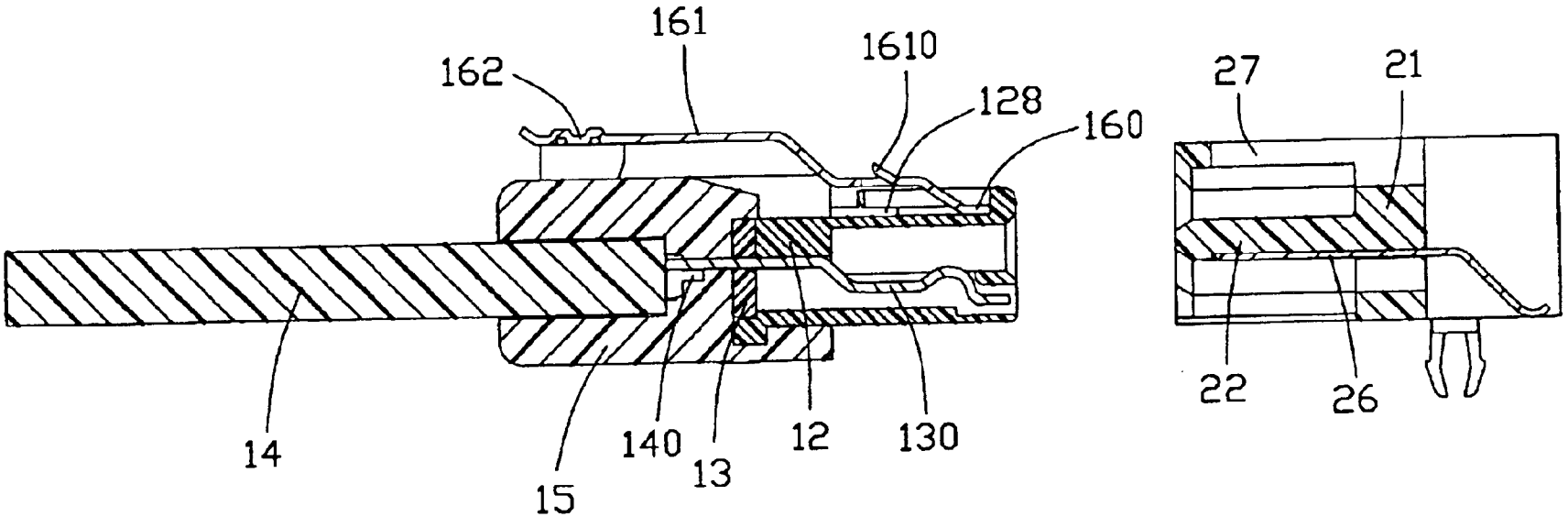
FIG. 7 is a cross-sectional view taken along line 7—7 of FIG. 1.
Figure 8:
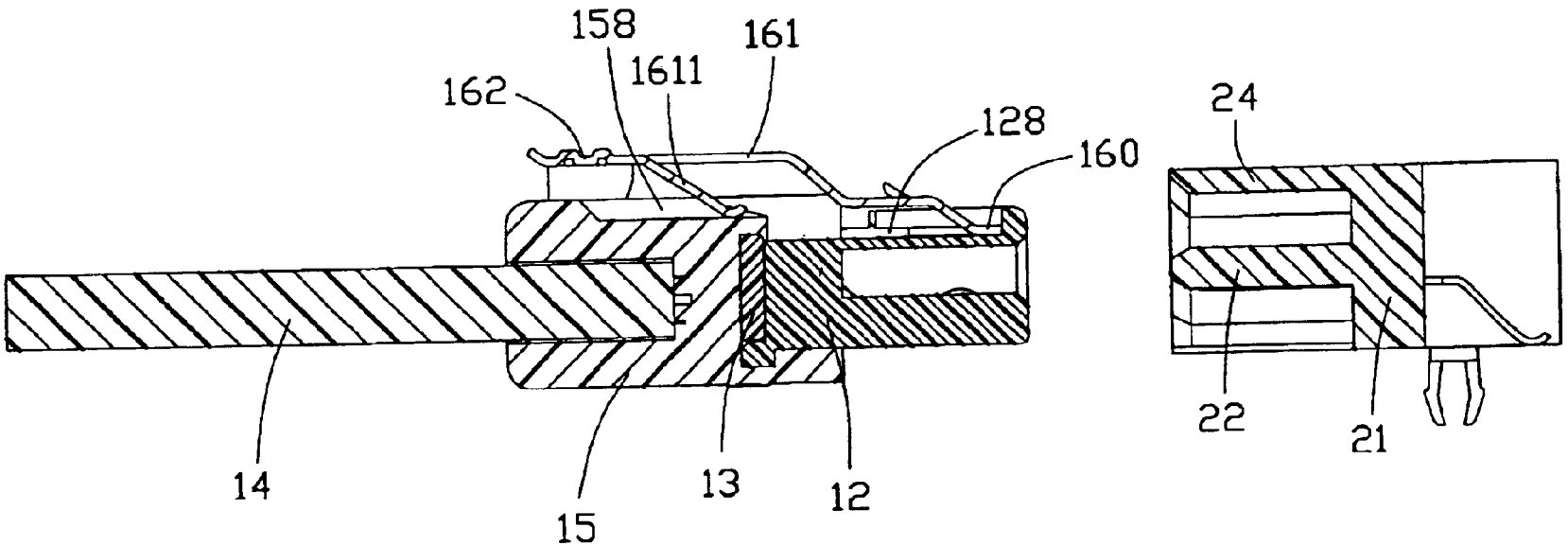
FIG. 8 is a cross-sectional view taken along line 8—8 of FIG. 1.
Figure 9:
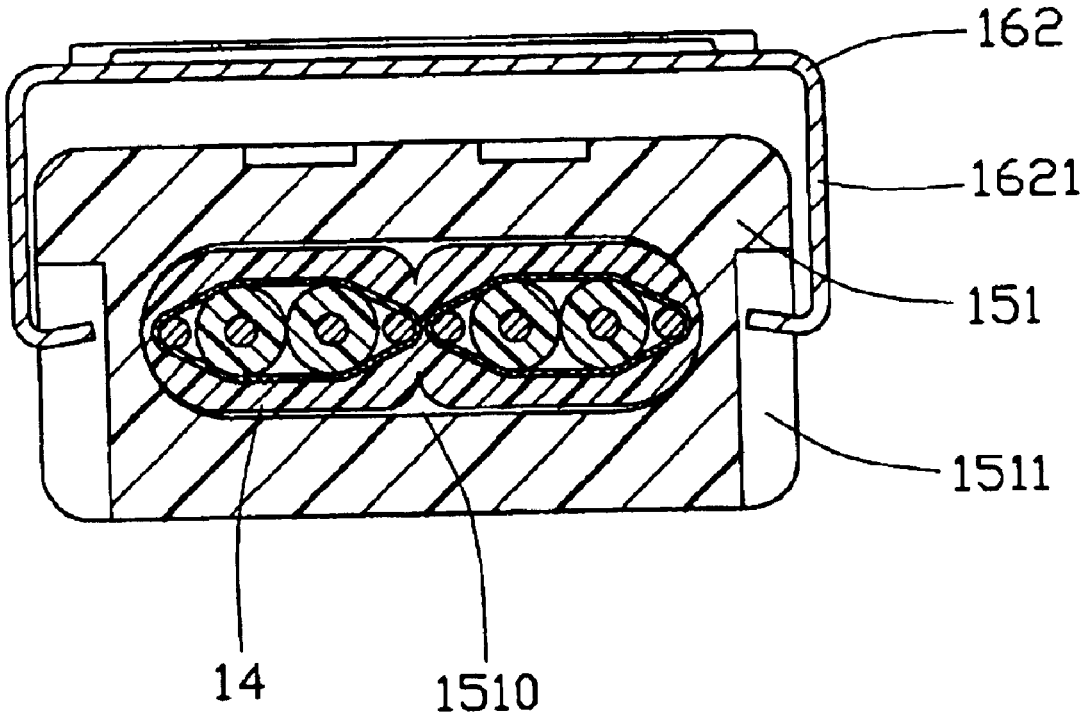
FIG. 9 is a cross-sectional view taken along 9—9 of FIG. 2.

Referring to FIGS. 1 and 2 in conjunction with FIGS. 5, 7 and 8, the complementary connector 20 comprises a base portion 21, a tongue portion 22 extending forwardly from a middle portion of the base portion 21, a pair of arm portions 23 extending from opposite ends of the base portion 21 in a mating direction of the complementary connector 20, and a protect portion 24 extending forwardly from an upper portion of the base portion 21 and connecting with upper sides of the pair of the arm portions 23. The arm portions 23 and the protect portion 24 define a mating space 25. A plurality of terminals 26 are received in the tongue portion 22 and each terminal 26 has a tail portion extending beyond a rear face of the base portion 21 for connecting to a printed circuit board (not shown) on which the complementary connector 20 is mounted. The protect portion 24 defines a pair of engaging openings 27 extending therealong and communicating with the mating space 25.

Figure 10:
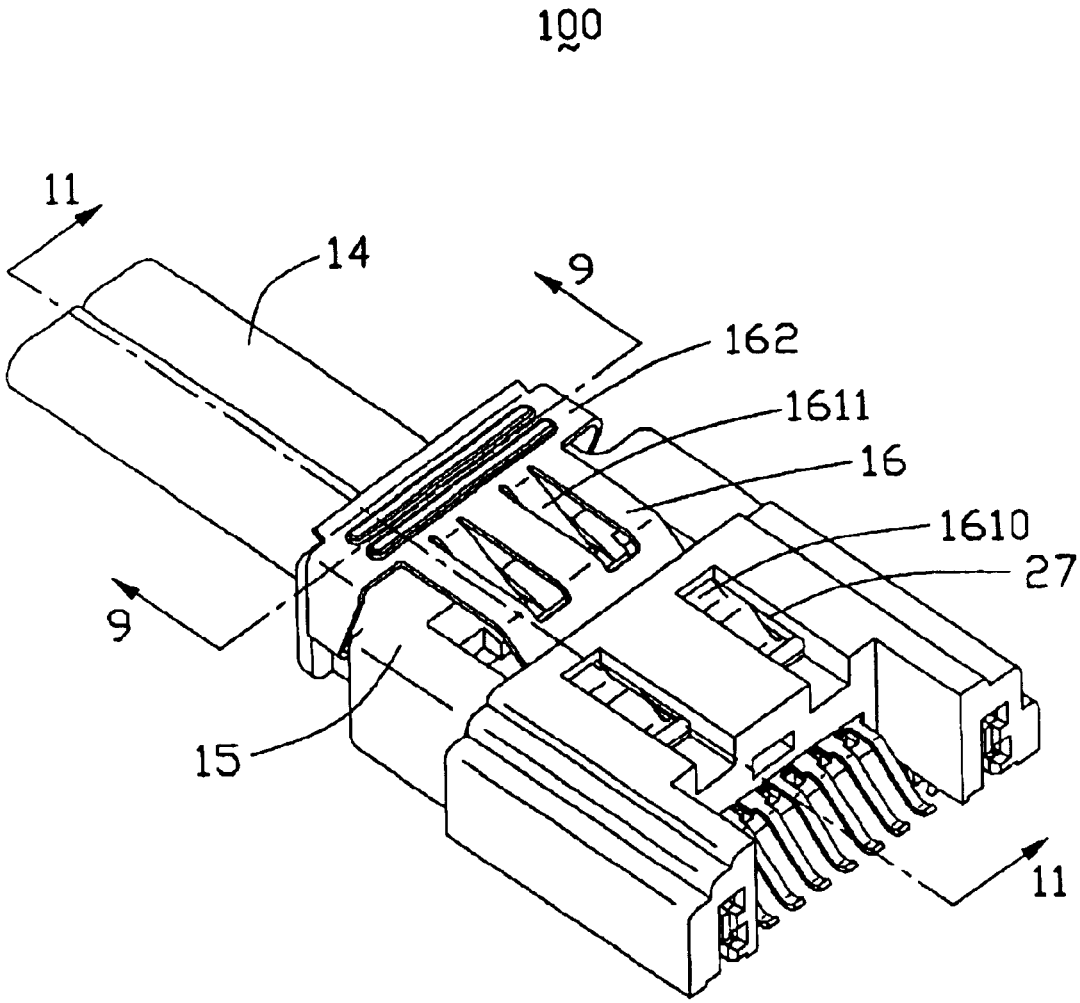
FIG. 10 is an assembled view of the cable end connector assembly and the complementary connector of FIG 1.
Figure 11:
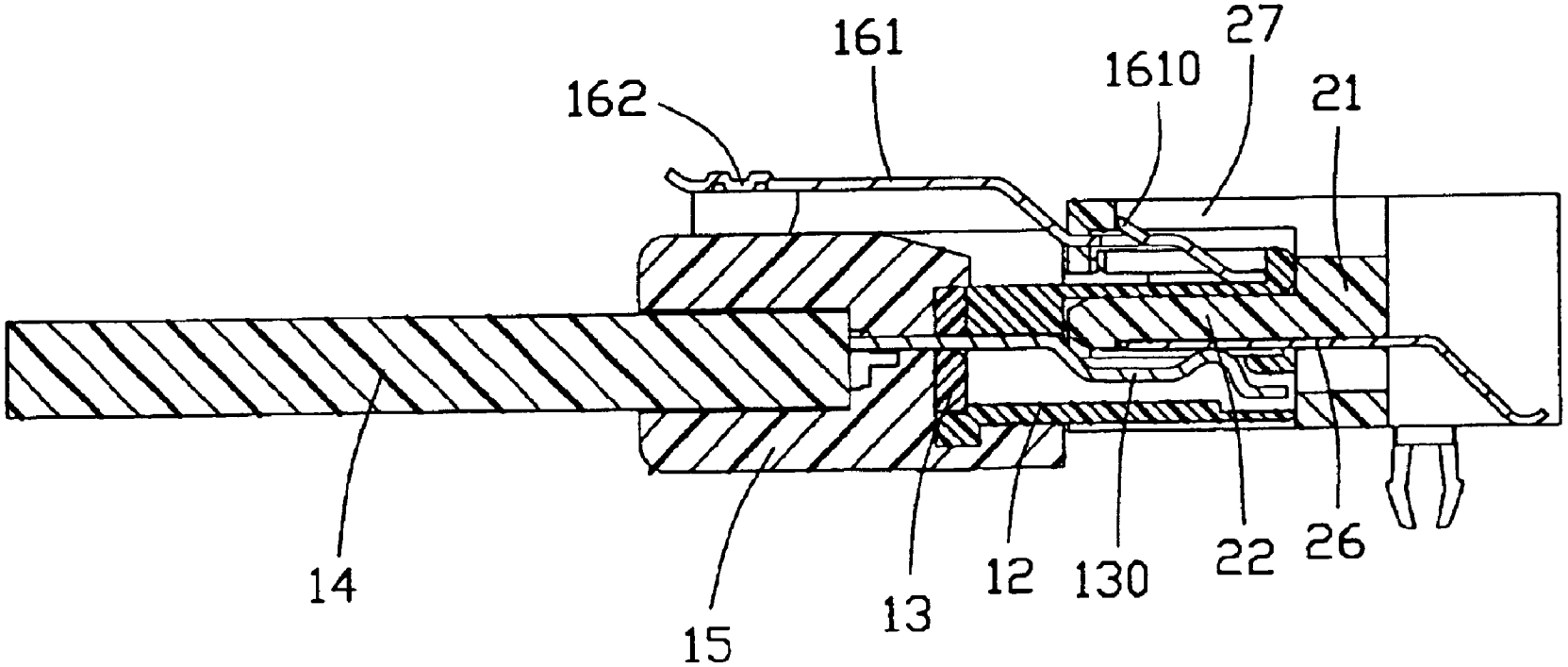
FIG. 11 is a cross-sectional view taken along line 11—11 of FIG. 10.

Referring to FIGS. 10 and 11, when the cable end connector assembly 10 is to be mated with the complementary connector 20, a pressing force is exerted on the pushing section 162 of the locking member 16 to deflect the lower tabs 1611 of the locking section 161, a front end of the cable end connector assembly 10 is inserted into the mating space 25 of the complementary connector 20 and the tongue portion 22 of the complementary connector 20 is received in the receiving space 123 of the cable end connector assembly 10. At the same time, the terminals 26 of the complementary connector 20 electrically connect with the contacts 130 of the cable end connector assembly 10. Once the pressing force is released, the locking section 161 and the lower tabs 1611 restore to their original configurations due to their own elasticity. The latch portions 1610 of the locking member 16 are locked in the corresponding engaging openings 27, thereby establishing a reliable engagement between the cable end connector assembly 10 and the complementary connector 20. When the cable end connector assembly 10 is to be disengaged from the complementary connector 20, a contrary operating procedure is applied.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly for mating with a complementary connector, comprising:

an insulative housing;

a plurality of contacts received in the insulative housing;

a cable comprising a plurality of conductors electrically connecting with corresponding contacts;

a cover enclosing a rear end of the insulative housing; and a locking member comprising a retaining section secured with the insulative housing and a locking section extending rearwardly from the retaining section, the locking section having a lower tab and a latch portion adapted for locking with the complementary connector;

wherein the insulative housing defines a pair of grooves, and wherein the retaining section of the locking member comprises a pair of bar portions extending from opposite ends thereof and received in the grooves;

wherein the insulative housing defines a slit receiving a middle portion of the retaining portion of the locking member;

wherein the insulative housing defines a slot communicating with the slit, and wherein the locking member comprises a snap portion extending from the middle portion of the retaining section and being locked with the slot.

2. The cable end connector assembly as claimed in claim 1, wherein the cover defines a channel therein, and wherein the lower tab of the locking member is received in the channel and resiliently abuts against a bottom surface of the channel.

3. The cable end connector assembly as claimed in claim 1, wherein the locking section comprises a pushing section formed on a rear portion thereof, the pushing section partially enclosing a rear portion of the cover and being downwardly movable relative to the rear portion of the cover to deflect the locking section toward the cover and the insulative housing.

4. The cable end connector assembly as claimed in claim 3, wherein the pushing section comprises a body portion, a pair of side beams extending downwardly from opposite ends of the body portion, and a bend portion extending from a rear end of the body portion.

5. The cable end connector assembly as claimed in claim 4, wherein the rear portion of the cover defines a pair of recesses on opposite sides thereof, and wherein distal ends of the pair of side beams are bent inwardly and received in the recesses.

6. The cable end connector assembly as claimed in claim 4, wherein the body portion of the pushing section is formed with a plurality of ribs.

7. A cable end connector assembly comprising:

a first connector mounted on a printed circuit board and including;

a first insulative housing;

a plurality of first contacts disposed in the first housing;

a first mating port formed on a front portion of the first housing and defining a mating space therein;

at least one engaging opening formed in a top wall of the first housing;

a second connector including:

a second insulative housing;

a plurality of second contacts disposed in the second housing;

a second mating port formed on a front portion of the second housing and mated with the first mating port;

a cable connected to a rear portion of the second housing and electrically connected to the corresponding second contacts, respectively;

a locking member mounted to the second housing, said locking member defining a retaining section at a front end thereof to form a fulcrum thereof so as to allow a beam to be restrictively up and down moveable at a rear end thereof; and at least one latch portion located on a front portion of the locking member close to the retaining section; wherein the second mating port is received in the mating space of the first connector, and the latch portion is latchably engaged within the engaging opening;

wherein the retaining section of said locking member further includes a snap portion retainably engaged with housing.

8. The assembly as claimed in claim 7, further including a resilient tab located around a rear portion of the locking member to constantly keep the beam in an upper position.

9. The assembly as claimed in claim 7, wherein said second housing defines a depression to receive the front portion of the locking member.

10. The assembly as claimed in claim 7, wherein said engaging opening is upwardly exposed to an exterior 14.

* * * * *